US009409686B2

(12) United States Patent
Cooper

(10) Patent No.: US 9,409,686 B2
(45) Date of Patent: Aug. 9, 2016

(54) WICK TO INDICATE PACKAGE OPENING

(71) Applicant: Owens-Brockway Glass Container Inc., Perrysburg, OH (US)

(72) Inventor: Scott P. Cooper, Perrysburg, OH (US)

(73) Assignee: Owens—Brockway Glass Container Inc., Perrysburg, OH (US)

( * ) Notice: Subject to any disclaimer, the term of this patent is extended or adjusted under 35 U.S.C. 154(b) by 583 days.

(21) Appl. No.: 13/832,628

(22) Filed: Mar. 15, 2013

(65) Prior Publication Data

US 2014/0260116 A1 Sep. 18, 2014

(51) Int. Cl.
*B65D 55/02* (2006.01)
*B65D 25/00* (2006.01)
*B65D 51/24* (2006.01)

(52) U.S. Cl.
CPC ..... *B65D 55/026* (2013.01); *B65D 25/00* (2013.01); *B65D 51/248* (2013.01); *B65D 2101/0084* (2013.01); *B65D 2203/12* (2013.01)

(58) Field of Classification Search
CPC ..... B65D 55/026; B65D 2101/00; B65D 5101/0084; B65D 2203/12; B65D 51/248
USPC ..... 215/901, 366, 200–364; 220/705–709, 220/200–380
See application file for complete search history.

(56) References Cited

U.S. PATENT DOCUMENTS

| | | | | |
|---|---|---|---|---|
| 765,439 | A | 7/1904 | Pike | |
| 2,235,453 | A | 3/1941 | Kirmes | |
| 3,399,811 | A | 9/1968 | Miller | |
| 3,724,756 | A * | 4/1973 | Maltenfort | B65D 51/32 239/44 |
| 4,424,911 | A | 1/1984 | Resnick | |
| 4,480,760 | A | 11/1984 | Schonberger | |
| 4,489,841 | A | 12/1984 | Thompson | |
| 4,511,052 | A | 4/1985 | Klein et al. | |
| 4,601,404 | A | 7/1986 | Shivers | |
| 4,733,786 | A | 3/1988 | Emslander | |
| 4,905,851 | A | 3/1990 | Thompson | |
| 5,145,079 | A | 9/1992 | Woodrow et al. | |
| 6,325,247 | B1 | 12/2001 | Iggulden | |
| 2005/0061814 | A1 * | 3/2005 | Jackel | A47G 19/2266 220/259.1 |

FOREIGN PATENT DOCUMENTS

| | | |
|---|---|---|
| FR | 2 611 659 A2 | 9/1988 |
| JP | H11318242 | 11/1999 |

OTHER PUBLICATIONS

PCT Int Search Report and Written Opinion, Serial No. PCT/US2014/020962, Int Filing Date: Mar. 6, 2014, Applicant: Owens-Brockway Glass Container Inc., Date of Mailing: May 19, 2014.

* cited by examiner

*Primary Examiner* — Jeffrey Allen
*Assistant Examiner* — Jennifer Castriotta

(57) ABSTRACT

A product includes a container having an interior surface, an exterior surface, and a lip between the interior and exterior surfaces, and a wick having a first end disposed inside the container, a second end disposed outside of the container, and an intermediate portion extending across the lip of the container. A package may include the product, a liquid product carried within the container, and a closure coupled to the container to squeeze the wick to interrupt flow of the liquid product therethrough.

17 Claims, 2 Drawing Sheets

WICK TO INDICATE PACKAGE OPENING

The present disclosure is directed to containers and, more particularly, to containers having anti-counterfeit features.

BACKGROUND AND SUMMARY OF THE DISCLOSURE

Many containers are provided with tamper-resistant devices to resist refilling of contents in the containers. For example, a beverage container can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product including a container and a package opening indicator carried by the container to indicate whether a package has been opened and, thus, provide evidence of efforts to repackage the container with counterfeit product.

The present disclosure embodies a number of aspects that can be implemented separately from or in combination with each other.

A product in accordance with one aspect of the disclosure includes a container having an interior surface, an exterior surface, and a lip between the interior and exterior surfaces, and a wick having a first end disposed inside the container, a second end disposed outside of the container, and an intermediate portion extending across the lip of the container.

In accordance with another aspect of the disclosure, there is provided a package that includes the aforementioned product, a liquid product carried in the container, and a closure coupled to the container to close the container and pinch the wick between the closure and the container to interrupt flow of the liquid product wicking therethrough.

In accordance with another aspect of the disclosure, there is provided a package that includes a container having a finish, a closure removably secured to the finish, and a wick extending from within the container over the finish and between the closure and the finish to indicate when the closure has been removed from the finish, the wick being squeezed by the closure against the finish to prevent transfer of liquid along the wick, such that removal of the closure allows liquid to travel along the wick to an observable portion of the wick outside of the container.

In accordance with a further aspect of the disclosure, there is provided a method of producing a package that includes coupling a wick to a container so that a first end of the wick extends into the container, a second end extends out of the container, and an intermediate portion extends over a lip of the container. The method also includes filling the container with a liquid product, and applying a closure to the container to pinch the wick between the closure and the container lip.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
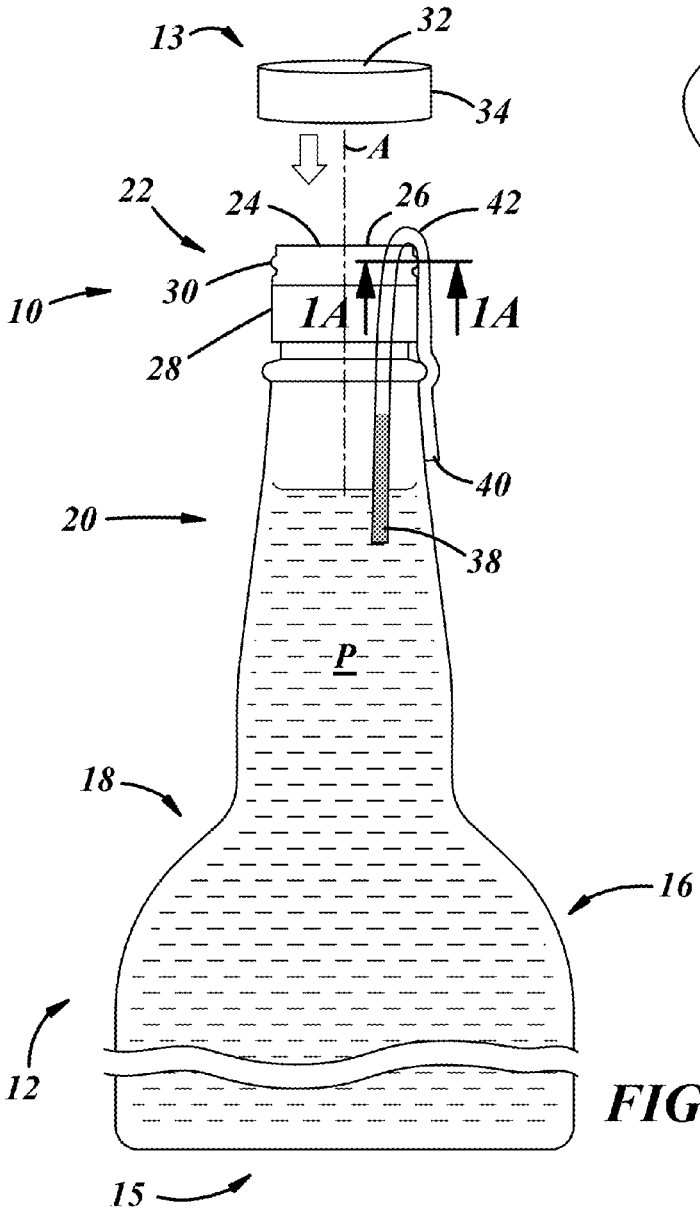
FIG. 1 is a fragmentary, exploded, perspective view of a package in accordance with an illustrative embodiment of the present disclosure, including a container holding a liquid product, a closure for the container, and a wick carried by the container.

FIG. 1 illustrates a package 10 in accordance with an illustrative embodiment of the disclosure. The package 10 includes a container 12, a closure 13 for the container 12, and a liquid product P filling the container 12. Additionally, the package 10 may include a package opening indicator in the form of a wick 14 carried by the container 12. As used herein, the phrase "carried by the container" includes carried in the container, carried on the container, coupled to the container, and/or the like. As will be described in further detail below, the wick 14 extends from a location inside the container 12 below a fill line or level of the liquid product P, under the closure 13, and to a location outside of the container 12. When the closure 13 is coupled to the container 12, the closure 13 squeezes or pinches the wick 14 between the closure 13 and the container 12 to interrupt wicking or capillary action of the wick 14 until such time as the closure 13 is removed and wicking resumes. As such, the wick 14 may facilitate evidencing of efforts to tamper with the package 10, by providing visible evidence that the package 10 has been opened from its original factory sealed condition. As used herein, the term "removal" may include partial or complete removal.

The container 12 may be of any suitable shape, and may include a jug, jar, bottle, other food or beverage container, or any other suitable container. The container 12 may include a base 15 on which the container 12 may be supported, a body 16 extending axially from the base 15, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to a container longitudinal central axis A. The body 16 and the neck 20 may be generally cylindrical, as illustrated, or they may be tapered or of any other suitable shape. The neck 20 may include a finish 22 (a neck finish in a bottle embodiment), which may include a radially interior surface 24, an axially outward end surface or lip 26, and a radially exterior surface 28 with one or more closure retention elements 30 projecting from the exterior surface 28, or the like, for cooperation with corresponding portions of the closure 13. The elements 30 may include threads or thread segments, bayonet features, snap-fit features, crown closure or crimp beads, or any other suitable closure retention features. As used herein, the term thread segment includes whole, partial, multiple, and/or an interrupted thread, thread segment, and/or lug.

The container 12 may be of one-piece integrally formed construction, for example, of glass, plastic, or any other suitable material. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 12 may be fabricated in press-and-blow, blow-and-blow, or hand blowing glass container manufacturing operations, or in a plastic injection and/or blow molding operation, or in any other suitable manner.

The closure 13 may include a cap, cork, plug, or any other suitable type of closure, and may be composed of plastic, metal, glass, ceramic, or any other suitable material. In any case, the closure 13 may include a base wall 32, and an annular outer skirt 34 extending from the base wall 32. The skirt 34 may have one or more internal container retention elements 36 (FIG. 2) projecting from an interior surface thereof for cooperation with corresponding portions of the container 12. Although not shown, the closure 13 also may include a seal on inside surface of the base wall 32 and/or an annular inner sealing skirt extending from the base wall 32 radially inward of the outer skirt 34. The elements 36 may include threads or thread segments, or bayonet features, snap-fit features, crimpable features, or any other suitable container retention features. The skirt 34 may be circumferentially continuous or may be circumferentially interrupted.

The wick 14 may be carried in any suitable location(s) of the container 12, both internally and externally of the container 12. In general, the wick 14 extends from within the container 12 over the finish 22 and between the closure 13 and the finish 22 to indicate when the closure 13 has been removed from the finish 22, wherein the wick 14 is squeezed by the closure 13 against the finish 22 to prevent transfer of liquid along the wick 14, such that removal of the closure 13 allows liquid to travel along the wick 14 to an observable portion of the wick 14 outside of the container 13. More specifically, the wick 14 may include a first end 38 inside the container 12, a second end 40 outside the container, and an intermediate or closure contact portion 42 between the ends 38, 40 and extending across the lip 26 of the container 12. The wick 14 may extend over or through the closure engagement feature(s) 30. The wick 14 is illustrated as having an elongated solid string-like shape, but the wick may have a ribbon-like shape, hollow cylindrical shape, or any other suitable shape(s). The wick 14 may be of flaccid or rigid structure, and may be carried by the container 12 in any suitable manner. For example, the wick 14 may be draped over the lip 26 and one or more portions may hang loosely inside and/or outside of the container 12 in one embodiment. In another embodiment, however, the wick 14 may be applied to, or carried directly on or in, one or more surfaces of the container 12.

In fact, one or more portions of the wick 14 may be non-removably secured to the container 12. The terminology "non-removably secured" includes a manner in which the wick 14 is, by design-intent, not intended to be removed from the container 12 without damaging the container 12, the wick 14, and/or any other portion(s) of the package 10, or otherwise visibly compromising the structural and/or functional integrity of any of the above. The wick 14 and/or the container 12 may include any suitable features to non-removably secure the wick 14 to the container 12. In one embodiment, the wick 14 may include an adhesive to secure the wick 14 to the container 12, or a separate adhesive may be applied between the wick 14 and the container 12.

Figure 1A:
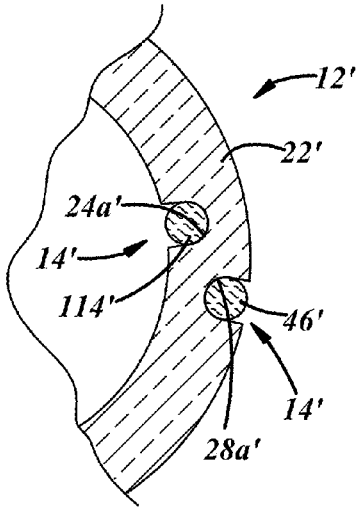
FIG. 1A is a fragmentary, cross-sectional view of a portion of a container and a wick according to another illustrative embodiment, and taken along line 1A of FIG. 1.

In another embodiment, represented by FIG. 1A, at least a portion of a wick 14' may be embedded in a wall of a container 12'. More specifically, an interior portion 114' of the wick 14' may be disposed in an interior channel **24*a*' of the container 12' and/or an observable or exterior portion 46' of the wick 14' may be disposed in an exterior channel 28*a*' of the container 12'. Likewise, although not illustrated, an intermediate portion of the wick 14' may extend across an axial lip of a neck finish 22' of the container 12', such that the wick 14' is disposed in a channel in the axial lip. Similarly, a portion of the wick 14' may be disposed in a radial channel in closure engagement feature(s) (not shown) of the container 12'. In a further embodiment, the aforementioned embodiments may be combined, such that the wick 14' may be carried in a channel of the container 12' with adhesive, either carried by the wick 14' or applied to the wick 14' and/or the container 12'**.

In any embodiment, with respect to FIG. 1, the closure 13 and/or the container 12 may carry any suitable axial and/or radial seals and/or may have any suitable channels in the container 12 to accommodate the thickness of the wick 14 so as to provide good sealing between the closure 13 and the container 12 despite the presence of the wick 14.

The wick 14 may include any suitable materials, components, or the like. For example, the wick 14 may be composed of fiber, fabric, plastic, metal, glass, ceramic, and/or any other suitable material(s) that are sufficiently absorbent, adsorbent, or otherwise facilitate capillary flow. The wick 14 also may include a liquid activated colorant, for example, a dye, dye crystals such as those used in litmus paper, or any other suitable colorant or the like, for example, to visually accentuate the presence of liquid wicking in the wick 14.

In an organic material embodiment, the wick 14 may be constructed and composed of a fibrous cellulose material. In this embodiment, the wick 14 may be relatively pliable, soft, and/or elastic to facilitate being pinched off between the closure 13 and the container 12.

In an inorganic material embodiment, the wick 14 may be constructed and composed of a silica material, for example, a silica gel. The silica gel may be particularly difficult to remove by a counterfeiter, and is especially compatible with glass recycling. The silica gel may be deposited in situ to the container 12, for example, to bond to the container 12. Accordingly, the wick 14 may be attached by screen printing, for example, using applied ceramic labeling or any other suitable techniques. In another embodiment, the wick 14 may be attached by brushing wick material on the container 12, spraying a strip of wick material on the container 12, or the like. The silica gel may be in the form of a slurry or suspension, and a binder, for example, silane, could be used to help couple the silica gel to the glass surface. Such a wick may require some heat to cure it, for example, less than 200 degrees Celsius. In one embodiment, the wick 14 could be applied to warm containers after they have exited an annealing lehr at the end of a hot end of a glass container manufacturing operation.

In another embodiment, it may be desirable to cover or protect a portion of the wick 14 that is on the exterior of the package 10, for example, to deter tampering therewith. Accordingly, a protective coating (e.g., silica oxide SiO2), a separate shrink sleeve, or a portion of the closure 13 perhaps with a viewing window, could cover the exterior portion of the wick 14 from tampering.

Accordingly, as used herein, the term "wick" includes an element of any construction and composition suitable to facilitate capillary action or flow, and may be separate from and/or integral with a container. The wick 14 facilitates verification of authenticity and identification of counterfeit product.

In one embodiment, a part of the wick 14 that is disposed exteriorly with respect to the container 12 may be of a certain composition, or may carry or contain the certain composition, to indicate an authentic product by changing color upon contact with the container contents as the contents moves through the wick 14. For example, the wick 14 may include an alcohol-responsive crystal that responds to the particular formulation of alcohol of the authentic product carried by the container 12.

In another embodiment, the wick 14 may be of a composition and/or construction that facilitates separation of the natural compounds in the authentic product. For example, when black food dye is spilled on a paper towel, the individual colors of the dye separate out as the dye wicks through the paper. In a similar fashion, the compounds present in the authentic product separate as they diffuse through the wick 14. The authentic product will exhibit a certain type of appearance (pattern, coloration, etc), and a counterfeit product will exhibit an appearance that is different from that exhibited by the authentic product. Any suitable materials may be incorporated in the wick 14, for example, materials used for thin layer chromatography may be particularly suitable.

In a further embodiment, the exterior portion of the wick 14 may be in the form of a design feature, decoration, or decorative pattern that may grow in size as more and more of the authentic product flows therethrough.

In production, and according to one embodiment, the product P may be dispensably disposed within the container 12 of the package 10. For example, a product manufacturer may fill the container 12 with an authentic, genuine, or original flowable product P at a packaging plant or factory. The product P may include a liquid or flowable solid, for example, a beverage, for instance, beer, wine, liquor, soda, or any other suitable beverage or liquid, or a flowable food of any kind. Thereafter, the wick 14 may be coupled to the container 12 so that the first end extends below the level of product P and so that the wick 14 is laid over the lip wherein the second end extends below the lip on the exterior surface of the container. In another embodiment, the wick 14 may be coupled to the container 12 before the product P is flowed into the container 12. For example, after the wick 14 is placed in a desired position with respect to the container 12, a fill nozzle may be inserted into the container 12 and product P may be flowed through the fill nozzle until the level of product P is above the first end of the wick 14. In any case, the product P will begin to flow up the wick 14 via capillary action.

Figure 2:
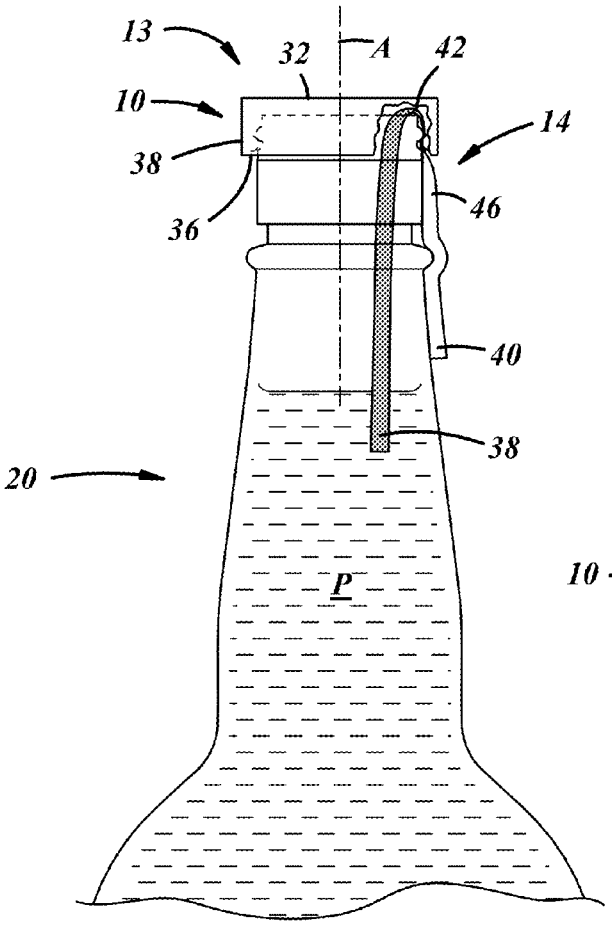
FIG. 2 is a fragmentary, cross-sectional view of the package of FIG. 1, illustrating the closure coupled to the container with the wick pinched therebetween.

But, with reference to FIG. 2, before such product flow reaches the container lip 42 via the wick 14, the closure 13 may be removably secured to the container 12 and, more specifically, the container finish 22. Securement of the closure 13 to the container 12 may cause the wick 14 to be pinched therebetween. The wick 14 may be pinched between the axial lip 26 (FIG. 1) of the container neck finish 22 (FIG. 1) and a corresponding axial portion of the closure 13, and/or by corresponding radial portions of the container 12 and the closure 13 (for instance an inner skirt or plug (not shown) of the closure 13). In other embodiments, a fitment or other component could be installed in the container neck 20 (FIG. 1) prior to assembly of the closure 13 to pinch the wick 14 between that component and the container 12. When the closure 13 is removed, that component could be carried off the container 12 by the closure 13 in any suitable manner, so that the component is removed upon opening of the package 10. In this way, the pinch point on the wick 14 may be inside the container neck 20 (FIG. 1) instead of on the axially facing lip 26 (FIG. 1). In any case, the package 10 leaves the packaging plant in an original factory sealed state or condition, with the exterior portion 46 of the wick 14 unactivated.

Figure 3:
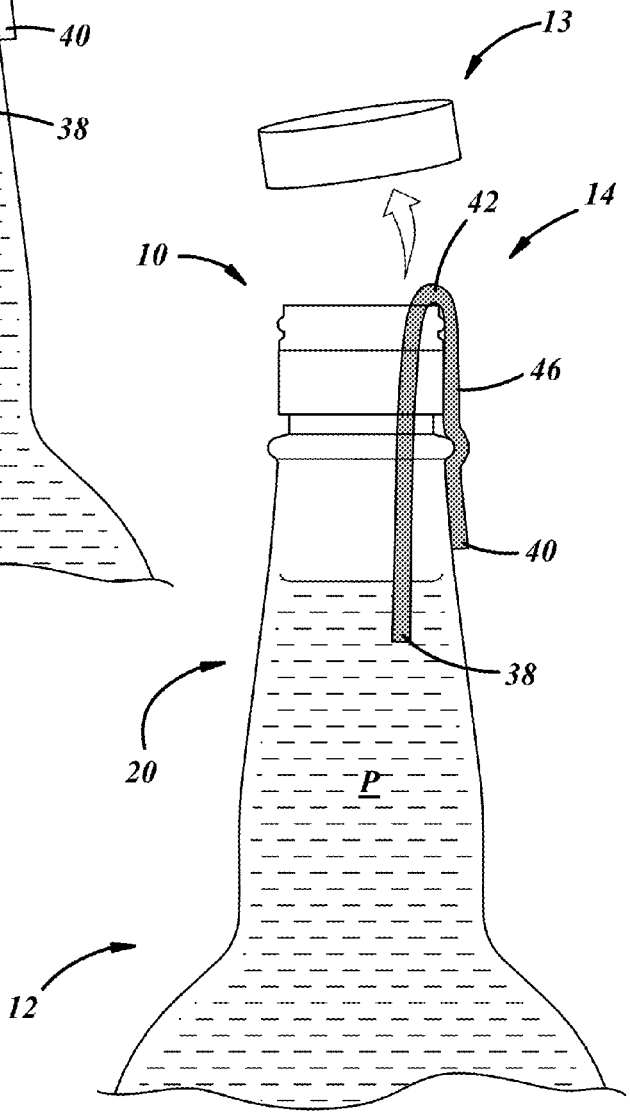
FIG. 3 is a fragmentary, exploded, perspective view of the package of FIG. 1, illustrating the closure removed from the container with an exterior portion of the wick in an activated state to indicate that the package has been opened.

Thereafter, and with reference to FIG. 3, after wholesale distribution or retail sale, for example, the closure 13 may be removed to allow the product P to be dispensed out of the container 12. When the closure 13 is removed from the container 12, by being displaced in a direction axially away from the container base 15 (FIG. 1), pressure on the wick 14 is relieved such that the wick 14 becomes unpinched or unsqueezed. Accordingly, liquid product will continue flowing through the wick 14 toward the second end 40 and thereby produce a change in coloration in the exterior portion 46 of the wick 14 that is observable or visible to an observer. Also, as used herein, the term "visible" includes visible to a human eye with or without aid of a special light, for example, an ultraviolet light, or the like. Accordingly, the state change of the coloration may be overt (visible to the human eye in natural daylight) or covert (visible to the human eye in the presence of a special light). The state change will deter a counterfeiter from refilling and/or repackaging the container 12 with counterfeit product. As used herein, the term "coloration" includes color, hue, transparency, and/or any other suitable coloration qualities.

According to other embodiments of the present disclosure, there are provided methods of producing and using a package. A method of producing a package may include coupling a wick to a container so that a first end of the wick extends into the container, a second end extends out of the container, and an intermediate portion extends over a lip of the container. The method also includes filling the container with a liquid product, and applying a closure to the container to pinch the wick between the closure and the container lip. A method of using the package produced by the method above may include removing the closure from the container to unpinch the wick so that the liquid product flows though the wick toward the second end to indicate opening of the package. Any suitable sequencing of the aforementioned steps may be used.

In a further embodiment, the presently disclosed wick may be used in conjunction with one or more of the embodiments disclosed and shown in U.S. patent application Ser. No. 13/832,729 filed Mar. 15, 2013 (entitled PACKAGE OR PRODUCT HAVING A USE INDICATOR), which was filed on the same date as the present application is assigned to the assignee hereof and is incorporated herein by reference in its entirety.

There thus has been disclosed a product, a package, and methods that fully satisfy all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A package comprising:

a product that includes:

a container having an interior surface, an exterior surface, and a lip between the interior and exterior surfaces; and a wick having a first end disposed inside the container, a second end disposed outside of the container, and an intermediate portion extending across the lip of the container; and a liquid product carried in the container, and a closure coupled to the container to close the container and pinch the wick between the closure and the container to interrupt flow of the liquid product wicking therethrough.

2. The package of claim 1 wherein the exterior surface of the container includes at least one closure engagement feature over or through which the wick extends.

3. The package of claim 1 wherein the container is composed of glass or ceramic and the wick is composed of an inorganic material.

4. The package of claim 3 wherein the wick is composed of a silica gel.

5. The package of claim 1 wherein the wick is composed of an organic material.

6. The package of claim 5 wherein the wick is composed of a fibrous cellulose material.

7. The package of claim 1 wherein the wick includes a liquid activated colorant.

8. The package of claim 1 wherein the closure includes a base wall, wherein the wick is pinched between the base wall and the container lip.

9. The package of claim 8 wherein the container includes at least one closure engagement feature and the closure includes an outer annular skirt extending axially from the base wall and including at least one container engagement feature for cooperation with the at least one closure engagement feature of the container.

10. A package that includes:

a container having a finish;

a closure removably secured to the finish; and a wick extending from within the container over the finish and between the closure and the finish to indicate when the closure has been removed from the finish, the wick being squeezed by the closure against the finish to prevent transfer of liquid along the wick, such that removal of the closure allows liquid to travel along the wick to an observable portion of the wick outside of the container.

11. The package set forth in claim 10 wherein the wick is disposed in a channel that extends along at least one of an inside surface or an outside surface of the finish.

12. The package set forth in claim 10 that includes a liquid product carried in the container, wherein the wick includes a first end extending below a level of the liquid product, a second end extending outside of the container, and an intermediate portion squeezed between the closure and the container.

13. The package of claim 10 wherein the container includes at least one closure engagement feature and the closure includes an outer annular skirt extending axially from the base wall and including at least one container engagement feature for cooperation with the at least one closure engagement feature of the container.

14. The package of claim 10 wherein the container is composed of glass or ceramic and the wick is composed of a silica gel or a cellulose material and includes a liquid activated colorant.

15. A method of producing a package that includes:

coupling a wick to a container so that a first end of the wick extends into the container, a second end extends out of the container, and an intermediate portion extends over a lip of the container;

filling the container with a liquid product; and applying a closure to the container to pinch the wick between the closure and the container lip.

16. A package produced by the method of claim 15.

17. A method of using the package of claim 16, including removing the closure from the container to unpinch the wick so that the liquid product flows though the wick toward the second end to indicate opening of the package.

* * * * *